US008567625B2

(12) United States Patent
Nemoto

(10) Patent No.: US 8,567,625 B2
(45) Date of Patent: Oct. 29, 2013

(54) SYNTHETIC RESIN CONTAINER HAVING A RECTANGULAR CYLINDRICAL PART AND A ROUND CYLINDRICAL NARROW PART

(75) Inventor: Yoshinori Nemoto, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 421 days.

(21) Appl. No.: 12/733,394

(22) PCT Filed: Aug. 27, 2008

(86) PCT No.: PCT/JP2008/065336

§ 371 (c)(1),
(2), (4) Date: Feb. 26, 2010

(87) PCT Pub. No.: WO2009/028571

PCT Pub. Date: Mar. 5, 2009

(65) Prior Publication Data

US 2010/0163515 A1 Jul. 1, 2010

(30) Foreign Application Priority Data

Aug. 31, 2007 (JP) ..... 2007-225359

(51) Int. Cl.
*B65D 1/02* (2006.01)
*B65D 23/10* (2006.01)

(52) U.S. Cl.
USPC ..... 215/384; 215/398; 220/771

(58) Field of Classification Search
USPC ..... 215/382–384, 398; 220/669, 675, 771
See application file for complete search history.

(56) References Cited

U.S. PATENT DOCUMENTS

| | | | | | |
|---|---|---|---|---|---|
| 3,536,500 | A * | 10/1970 | Cleereman et al. | ..... | 426/130 |
| 3,537,498 | A * | 11/1970 | St. Amand | ..... | 604/403 |
| 5,224,614 | A * | 7/1993 | Bono et al. | ..... | 215/384 |
| 6,161,713 | A * | 12/2000 | Krich | ..... | 215/384 |
| D451,033 | S * | 11/2001 | Iizuka et al. | ..... | D9/569 |
| D467,507 | S * | 12/2002 | Bryant et al. | ..... | D9/570 |
| 6,637,613 | B2 * | 10/2003 | Shimada et al. | ..... | 215/382 |
| 6,830,158 | B2 * | 12/2004 | Yourist | ..... | 215/381 |
| 7,159,729 | B2 * | 1/2007 | Sabold et al. | ..... | 215/382 |
| 7,198,164 | B2 * | 4/2007 | Yourist et al. | ..... | 215/381 |
| 7,296,702 | B2 * | 11/2007 | Tanaka et al. | ..... | 215/383 |
| D626,850 | S * | 11/2010 | Zoppas | ..... | D9/541 |
| 8,047,390 | B2 * | 11/2011 | Strasser et al. | ..... | 215/381 |
| 2001/0037992 | A1 * | 11/2001 | Tanabe et al. | ..... | 215/384 |
| 2004/0129598 | A1 * | 7/2004 | Zhang et al. | ..... | 206/524.8 |
| 2008/0006601 | A1 * | 1/2008 | Stoddard | ..... | 215/383 |
| 2009/0266786 | A1 * | 10/2009 | Sasaki | ..... | 215/384 |

FOREIGN PATENT DOCUMENTS

| | | |
|---|---|---|
| JP | 2003-191319 | 7/2003 |
| JP | 2005-187053 | 7/2005 |
| JP | 2008-007147 | 1/2008 |

* cited by examiner

*Primary Examiner* — Sue A Weaver
(74) *Attorney, Agent, or Firm* — Manabu Kanesaka

(57) ABSTRACT

A synthetic resin container including a mouth part 2, a shoulder part 3, a trunk part 4 and a bottom part 5, wherein the trunk part 4 has rectangular cylindrical parts 41 and 42, and a round cylindrical part 43 which is formed by narrowing into a cylindrical shape a region between the upper rectangular cylindrical part 41 positioned near the shoulder part 3 and the lower rectangular cylindrical part 42 positioned near the bottom part 5 side.

9 Claims, 13 Drawing Sheets

(a)

(b)

SYNTHETIC RESIN CONTAINER HAVING A RECTANGULAR CYLINDRICAL PART AND A ROUND CYLINDRICAL NARROW PART

RELATED APPLICATIONS

The present application is National Phase of International Application No. PCT/JP2008/065336 filed Aug. 27, 2008, the disclosure of which is hereby incorporated by reference herein in its entirety.

TECHNICAL FIELD

The Invention relates to a synthetic resin container molded into a shape of a bottle.

BACKGROUND ART

A synthetic resin container obtained by a method in which a preform is formed by using a synthetic resin such as polyethylene terephthalate, and this preform is then molded into a shape of a bottle by stretch blow molding or the like has heretofore been known as a container for beverages which contains various beverages.

Such a synthetic resin container has been rapidly spread and infiltrated in recent years. With such a wide spread, the container has been strongly required to be light in weight. Among these containers, as for containers with a relatively large capacity for accommodating drink water, tea, or the like, an increased weight with an increase in size has come to be regarded as a problem. At the same time, elimination of cost disadvantages caused by an increase in the amount of a raw material resin is also required.

For this reason, Patent Document 1 states that the average wall thickness of a bottle-shaped container is adjusted to be 0.1 to 0.2 mm in order to reduce in weight of a container, as well as to decrease the amount of a resin. That is, in order to reduce the weight of a container and to decrease the amount of a raw material resin, reduction in wall thickness of a container is considered to be necessary.

Patent Document 1: JP-A-2003-191319

DISCLOSURE OF THE INVENTION

Problems to be Solved by the Invention

However, if the wall thickness of a container is simply reduced, the rigidity of the container is deteriorated due to such reduction in wall thickness. Particularly, if the rigidity of a part which is held by a user when holding up a container is not ensured sufficiently, the following troubles may occur. For example, when a user holds up an opened container in an attempt to transfer the contents thereof to another container such as a glass, the container is pressed and deformed by the force applied when holding the container, resulting in ejection of the contents. Such a problem occurs frequently when an unnecessarily strong force is applied to hands holding a container when a user attempts to hold up a full, heavy container immediately after unsealing.

Generally, this type of bottle-shaped synthetic resin containers are roughly divided into a rectangular bottle having a rectangular cylindrical container shape and a round bottle having a cylindrical container shape. The rectangular bottles can be efficiently accommodated in a box when packed for transportation, and are also conveniently accommodated in a refrigerator for domestic uses. For this reason, in many cases, rectangular bottles are used as a large-capacity container which accommodates drinking water, tea or the like. However, rectangular bottles have a strong tendency that they lose rigidity due to the reduced wall thickness. In order to avoid such a problem, an attempt has been made to impart various shapes to a part which is grasped by a user when holding up a container.

The present invention has been made as a result of intensive studies on the shape of a part of a container which is held by a user when holding up the container. The object of the present invention is to provide a synthetic resin container in which a decrease in rigidity which is caused by a reduced wall thickness, in particular, a decrease in rigidity in a part which is held by a user when holding up the container is suppressed, while maintaining advantages equivalent to those of conventional rectangular bottles such as packing efficiency.

Means for Solving the Problems

The synthetic resin container of the present invention comprises a mouth part, a shoulder part, a trunk part and a bottom part, wherein said trunk part has a rectangular cylindrical part of which the cross section orthogonally crossing the height direction has a square shape or a rectangular shape; and a round cylindrical narrow part which is formed by narrowing a predetermined height position of said rectangular cylindrical part.

Advantageous Effects of the Invention

According to the synthetic resin container of the present invention with the above-mentioned configuration in which the cross section orthogonally crossing the height direction is square or rectangular, advantages equivalent to those of conventional rectangular bottles, such as improved packing efficiency can be ensured. By narrowing a prescribed height position of the rectangular cylindrical part in a circular shape, lowering in rigidity associated with a reduction in wall thickness can be significantly reduced.

BRIEF DESCRIPTION OF THE DRAWINGS

FIG. 1(*b*) is a front view showing one example of the synthetic resin container according to the present invention;

FIG. 1(*c*) is a side view showing one example of the synthetic resin container according to the present invention;

FIG. 2(*b*) is a cross-sectional view of the synthetic resin container taken along the line B -B of FIG. 1(*c*);

FIG. 2(*c*) is a cross-sectional view of the synthetic resin container taken along the line C -C of FIG. 1(*c*);

FIG. 2(*d*) is a cross-sectional view of the synthetic resin container taken along the line D -D of FIG. 1(*c*);

FIG. 3(*b*) is a reference front view for explaining the specific shape of one example of the synthetic resin container according to the present invention;

FIG. 4(*b*) is a front view showing another example of the synthetic resin container according to the present invention;

FIG. 4(*c*) is a side view showing another example of the synthetic resin container according to the present invention;

FIG. 5(*b*) is a cross-sectional view of the synthetic resin container taken along the line E -E of FIG. 5(*a*);

FIG. 6(*b*) is a side view showing still another example of the synthetic resin container according to the present invention;

FIG. 6(*c*) is a cross-sectional view of the synthetic resin container taken along the line F -F of FIG. 6(*a*);

FIG. 7(*b*) is a front view showing still another example of the synthetic resin container according to the present invention;

FIG. 7(*c*) is a side view showing still another example of the synthetic resin container according to the present invention;

FIG. 8(*b*) is a front view showing still another example of the synthetic resin container according to the present invention;

FIG. 8(*c*) is a side view showing still another example of the synthetic resin container according to the present invention;

FIG. 9(*b*) is a front view showing still another example of the synthetic resin container according to the present invention;

FIG. 9(*c*) is a side view showing still another example of the synthetic resin container according to the present invention;

FIG. 10(*b*) is a front view showing still another example of the synthetic resin container according to the present invention;

FIG. 10(*c*) is a side view showing still another example of the synthetic resin container according to the present invention;

FIG. 10(*d*) is a cross-sectional view of the synthetic resin container taken along the line G -G of FIG. 10(*b*);

FIG. 11(*b*) is a front view showing still another example of the synthetic resin container according to the present invention;

FIG. 11(*c*) is a side view showing still another example of the synthetic resin container according to the present invention;

FIG. 11(*d*) is a cross-sectional view of the synthetic resin container taken along the line H -H of FIG. 11(*b*);

FIG. 12(*b*) is a front view showing still another example of the synthetic resin container according to the present invention;

FIG. 12(*c*) is a side view showing still another example of the synthetic resin container according to the present invention;

FIG. 12(*d*) is a cross-sectional view of the synthetic resin container taken along the line I -I of FIG. 12(*b*);

FIG. 13(*c*) is a side view showing still another example of the synthetic resin container according to the present invention; and FIG. 13(*d*) is a cross-sectional view of the synthetic resin container taken along the line J -J of FIG. 13(*b*).

BEST MODE FOR CARRYING OUT THE INVENTION

Preferred embodiments of the present invention will be explained hereinbelow with reference to the drawings.

Figure 1:
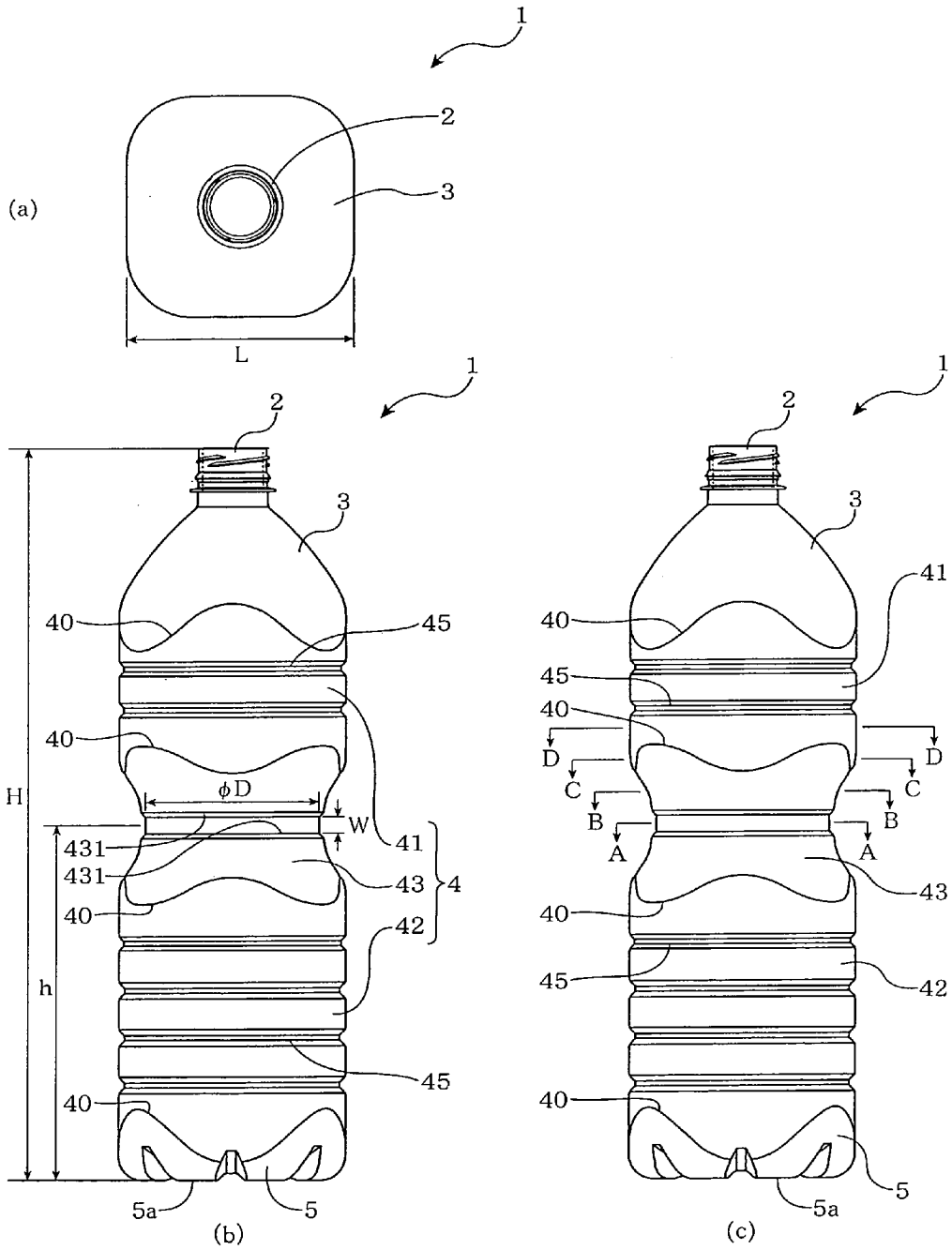
FIG. 1(*a*) is a plan view showing one example of the synthetic resin container according to the present invention.

FIG. 1 is an explanatory view showing one example of the synthetic resin container according to this embodiment, in which FIG. 1(*a*) is a plan view, FIG. 1(*b*) is a front view and FIG. 1(*c*) is a side view.

A container 1 shown in FIG. 1 is provided with a mouth part 2, a shoulder part 3, a trunk part 4 and a bottom part 5.

The mouth part 2 has a cylindrical shape. On the side thereof, a thread for fitting a lid (not shown) is provided as a lid-fitting means. The container 1 can be sealed after it is filled with the content by installing the lid on the mouth part 2.

The shoulder part 3 is positioned between the mouth part 2 and the trunk part 4, and is formed such that it concentrically increases in diameter, thereby to continue to the trunk part 4 from a position immediately below the mouth part 2.

The trunk part 4 is positioned between the shoulder part 3 and the bottom part 5, and has rectangular cylindrical parts 41 and 42 which are formed in a rectangular cylindrical shape. Further, by narrowing a region between the upper rectangular cylindrical part 41 positioned near the shoulder part 3 and the lower rectangular cylindrical part 42 positioned near the bottom part 5 in a cylindrical shape, a round cylindrical narrow part 43 is formed.

Here, the "height direction" means a direction which orthogonally crosses the horizontal plane when the container 1 is placed on the horizontal plane with the mouth part 2 being directed upwardly.

Figure 4:
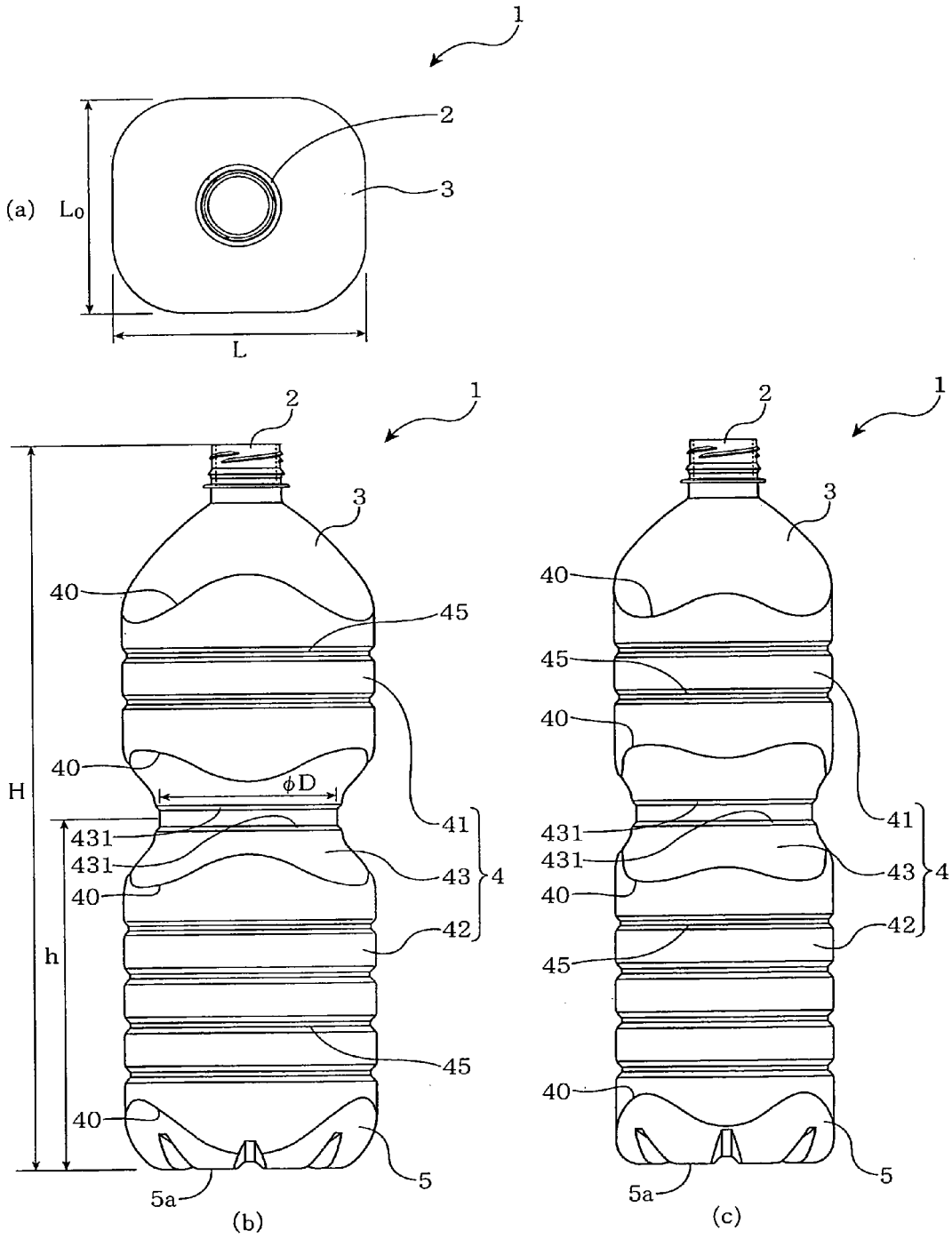
FIG. 4(*a*) is a plan view showing another example of the synthetic resin container according to the present invention.

In the example shown in FIG. 1, the rectangular cylindrical parts 41 and 42 each have a square cross section which orthogonally crosses the height direction of the container (hereinafter simply referred to as the "cross section"). However, the shape of the cross section may be rectangular as shown in FIG. 4. As for the rectangular cylindrical parts 41 and 42, in forming them into a rectangular cylindrical shape with a square or rectangular cross section, it is possible to round off the corner parts thereof to allow them to have round corners, as shown in the drawing.

FIG. 4 is an explanatory view showing another example of the synthetic resin container according to this embodiment. FIG. 4(*a*) is a plan view, FIG. 4(*b*) is a front view and FIG. 4(*c*) is a side view.

As mentioned above, due to the presence of the rectangular cylindrical parts 41 and 42 of which the cross section has a square or rectangular shape, the shape of the outermost peripheral part of the container 1 (the shape of the plane part which constitutes the outermost peripheral plane) becomes similar to that of a so-called rectangular bottle. In this way, the container 1 can ensure the same advantages as those of the conventional rectangular bottles such as improved efficiency in packing in a box or easiness in accommodation in a refrigerator.

The container 1 can be molded by stretch blow molding, as mentioned later. In this case, in the round cylindrical narrow part 43 which is narrowed in a cylindrical shape, the degree of extension is small as compared with the rectangular parts 41 and 42, whereby the thickness thereof becomes relatively large. In addition, the preform is extended isotropically, the wall thickness distribution does not have any polarity. Therefore, it is possible to form the round cylindrical narrow part 43 such that it has a uniform wall thickness along the circumferential direction. As a result, the rigidity of the round cylindrical narrow part 43 can be enhanced, whereby the amount of the raw material resin in molding the container 1 can be reduced, and, when making the entire container 1 thinner, lowering in rigidity in the container 1 caused by the reduction in wall thickness can be significantly suppressed as compared with the case of conventional rectangular bottles.

In forming the round cylindrical narrow part 43, in this embodiment, the cross section of the narrowest part thereof is allowed to be circular. The cross section of the narrowest part is not necessarily complete circle. However, in order to ensure rigidity, it is desirable to design such that it becomes a circle which is as much complete as possible.

Figure 2:
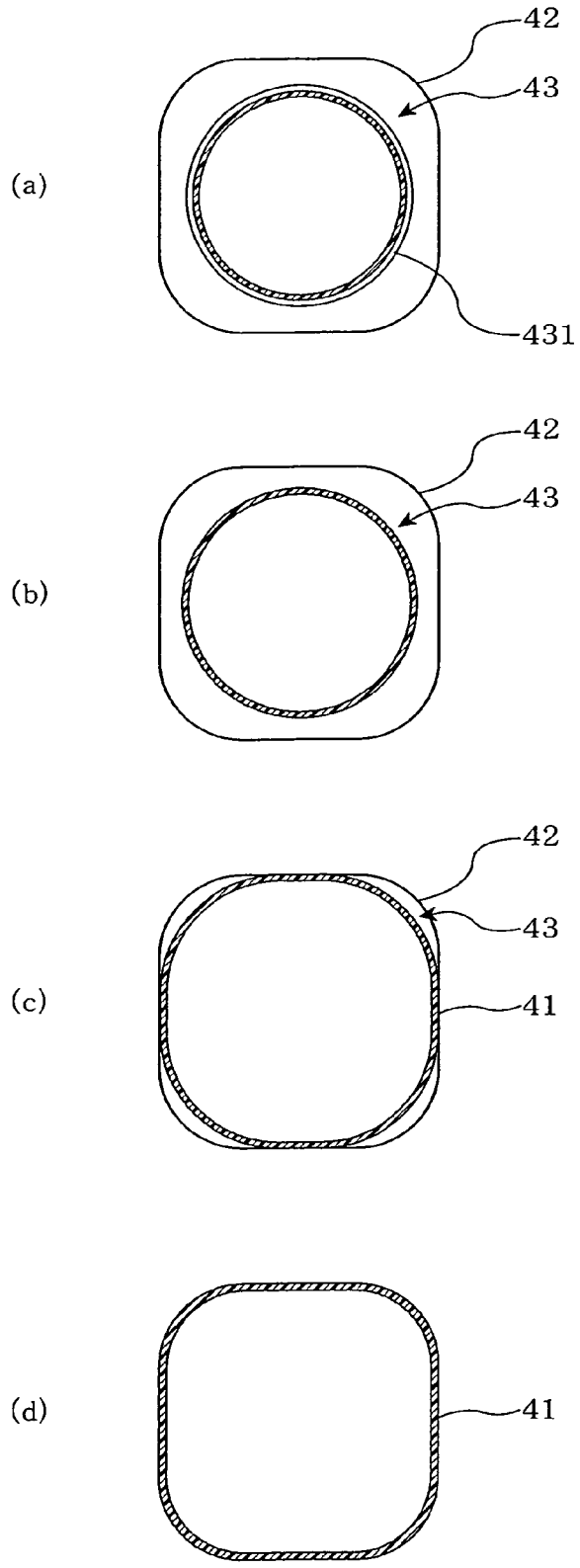
FIG. 2 (a) is a cross-sectional view of the synthetic resin container taken along the line A-A of FIG. 1(*c*)

In addition, regarding the round cylindrical narrow part 43, as shown in FIG. 2, it is preferred that the round cylindrical narrow part 43 have a configuration in which the upper end part of the round cylindrical narrow part 43 continues to the rectangular cylindrical part 41 and the lower end part of the round cylindrical narrow part 43 continues to the rectangular cylindrical part 42 so that the narrowest part thereof concentrically increases in diameter in the height direction of the container, thereby to change to have the cross-sectional shapes of the rectangular cylindrical parts 41 and 42. As a result, a wider range in which the cross section becomes circular can be ensured, whereby rigidity of the round cylindrical narrow part 43 can be more improved.

FIGS. 2(*a*), (*b*), (*c*) and (*d*) are a cross sectional view taken line along A-A, a cross sectional view taken along line B-B, a cross sectional view taken along line C-C and a cross sectional view taken line along D-D of FIG. 1(*c*), respectively. In addition, in these cross sectional views, for the convenience of drawing, the wall thickness of the cross section of the trunk part 4 is shown in an exaggerated manner. Further, the internal morphology of the container 1, which can be seen from a section of the trunk part 4, is not shown.

In the shown example, as mentioned above, the shoulder part 3 of the container 1 is formed such that it continues to the trunk part 4 from a part immediately below the cylindrical mouth part 2 while concentrically increasing the diameter thereof. Due to such a configuration, rigidity of the shoulder part 3 can be increased as in the case of the round cylindrical narrow part 43.

In ensuring rigidity of the container 1, it is preferred that a clear ridge be formed in a boundary between the rectangular cylindrical parts 41 and 42 and the round cylindrical narrow part 43, as shown in the drawing. Similarly, by allowing a clear ridge line 40 to be formed in a boundary between the rectangular cylindrical part 41 and the shoulder part 3, as well as in a boundary between the rectangular part 42 and the bottom part 5, rigidity of these parts or the vicinity of these parts can be ensured.

Figure 7:
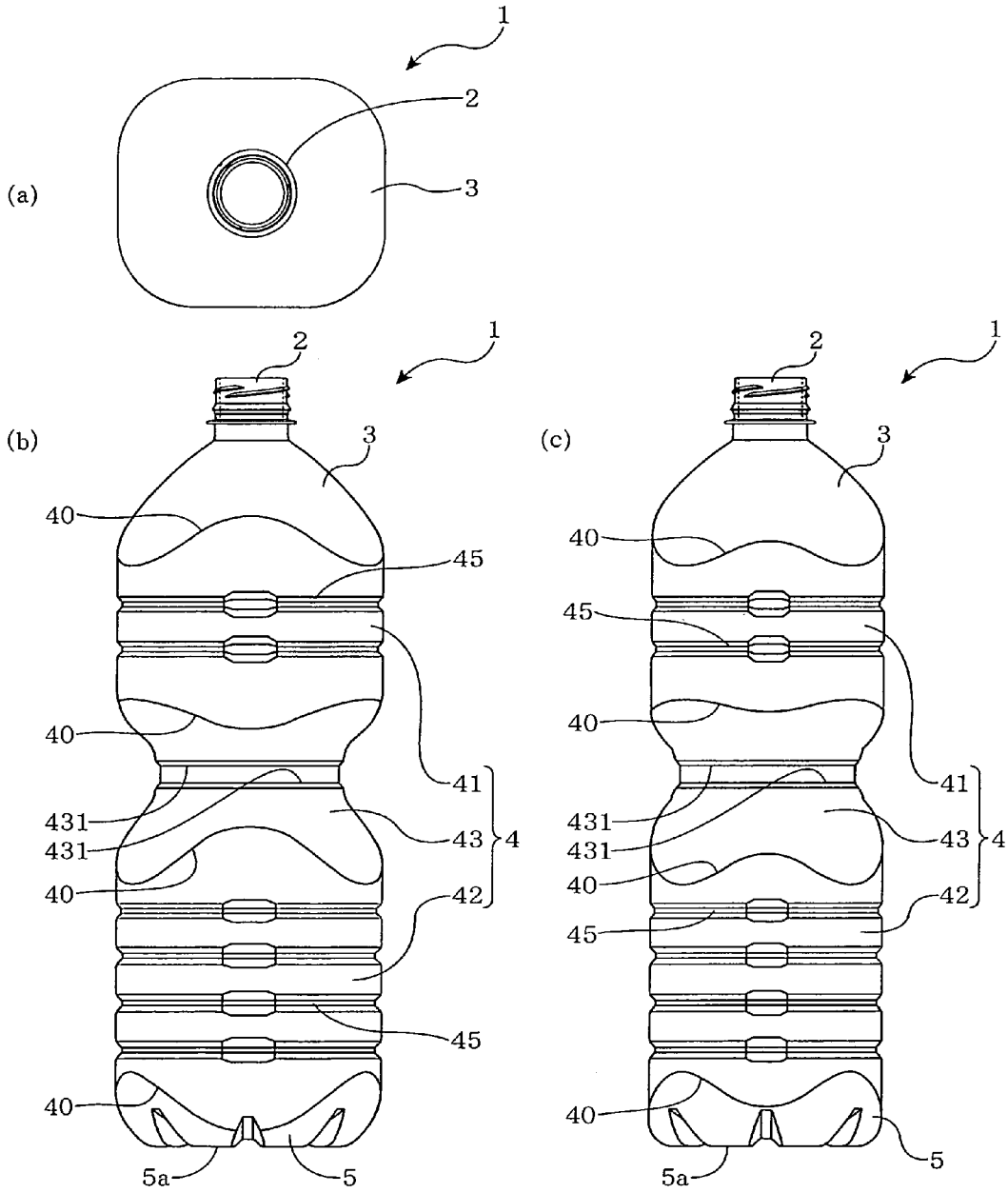
FIG. 7(*a*) is a plan view showing still another example of the synthetic resin container according to the present invention.

Further, in order to enhance the rigidity of the rectangular cylindrical parts 41 and 42, a lateral groove 45 can be circumferentially formed as shown in the drawing. In this embodiment, however, such groove 45 can be omitted according to need. If the lateral groove 45 is formed in the rectangular cylindrical parts 41 and 42, as shown in FIG. 7, for example, the width, depth or the like of the lateral groove 45 may be partially changed. In the example shown in FIG. 7, in almost the middle part of each side in the width direction of the rectangular cylindrical parts 41 and 42, the width or depth of the lateral groove 45 is changed.

Meanwhile, FIG. 7 is an explanatory view for showing still another example of the synthetic resin container according to this embodiment, in which FIG. 7(*a*) is a plan view, FIG. 7(*b*) is a front view and FIG. 7(*c*) is a side view.

In this embodiment, the round cylindrical narrow part 43 which is formed by narrowing into a cylindrical shape a part between the upper rectangular cylindrical part 41 and the lower rectangular cylindrical part 42 serves as a grasping part which is grasped by a user when holding up the container 1. Therefore, when considering the grasping properties of the round cylindrical narrow part 43, it is preferred that the round cylindrical narrow part 43 do not give unpleasant feelings to a user; specifically, it is desirable that the corner parts of the cylindrical rectangular parts 41 and 42 do not touch the hands of a user who holds the round cylindrical narrow part 43.

For this reason, in the shown example, a boundary between the rectangular cylindrical part 41 and the round cylindrical narrow part 43 in the upper part in the height direction is positioned most closely to the shoulder part 3 in the corner parts of the rectangular cylindrical part 41, and a boundary between the rectangular cylindrical part 42 and the round cylindrical narrow part 43 in the lower part in the height direction is positioned most closely to the bottom part 5 in the corner parts of the rectangular cylindrical part 42. As a result, when a user grasps the narrowest portion of the round cylindrical narrow part 43 between a thumb and a forefinger, for example, in order to hold the container 1, a sufficient space is provided between the corner part of the upper rectangular cylindrical part 41 and the back of the hand, and, at the same time, the palm of the hand can be fit to the round cylindrical narrow part 43, whereby the user can hold the container 1 easily.

At this time, the diameter ΦD of the narrowest portion of the round cylindrical narrow part 43 is designed taking into consideration the common size of the hand of a user which holds the round cylindrical narrow part 43. In order to allow the round cylindrical narrow part 43 to be easily grasped, the diameter thereof is normally about 45 to 95 mm. In order to allow the round cylindrical narrow part 43 to be comfortably held by as many users as possible irrespective of age and gender, it is preferred that the diameter of the round cylindrical narrow part 43 do not exceed 70 mm.

It is preferred that the narrowing ratio of the round cylindrical narrow part 43 relative to the rectangular cylindrical parts 41 and 42 be 0.67 to 0.77. If the round cylindrical narrow part 43 is formed with such a narrowing ratio, a desired compression strength can be easily ensured when the container 1 is filled with contents and sealed.

In this embodiment, in calculating the narrowing ratio of the round cylindrical narrow part 43 relative to the rectangular cylindrical parts 41 and 42 in this embodiment, if the cross section of the rectangular cylindrical parts 41 and 42 is square, the ratio is calculated by ΦD/L with the length of the longer side being taken as L (see FIG. 1), and if the cross section of the cylindrical rectangular parts 41 and 42 is rectangular, the ratio is calculated by ΦD/L with the length of the longer side being taken as L (see FIG. 4).

The position at which the round cylindrical narrow part 43 is formed can be determined taking into consideration the balance or the like when the container 1 is held up by grasping the round cylindrical narrow part 43.

In view of this, it is preferred that the position at which the round cylindrical narrow part 43 is formed be determined such that, relative to the height H of the container 1, the height h from a grounded surface 5*a* of the bottom part 5, the surface which touches the ground when the container 1 is placed upright, to the narrowest portion of the round cylindrical narrow part 43 become h/H=0.35 to 0.65

Although not particularly shown, a plurality of round cylindrical narrow parts 43 may be formed according to the size of the container 1.

In the narrowest portion of the round cylindrical narrow part 43, as shown, a pair of steps 431 and 431 positioned above and below in the height direction with said part being disposed therebetween may be formed along the circumferential direction. By forming such steps 431 and 431, the rigidity of the round cylindrical narrow part 43 which serves as a grasping part can be further improved.

At this time, the width W by which the steps 431 and 431 are spaced apart from each other upwardly and downwardly is designed taking into consideration the common hand size of a user (thickness of fingers) so that the fingers which hold the round cylindrical narrow part 43 step across the both steps 431 and 431. However, the width is normally about 2 to 15 mm.

Figure 3:
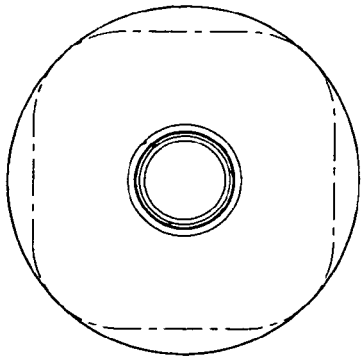
FIG. 3(*a*) is a reference plan view for explaining the specific shape of one example of the synthetic resin container according to the present invention.
Figure 3:
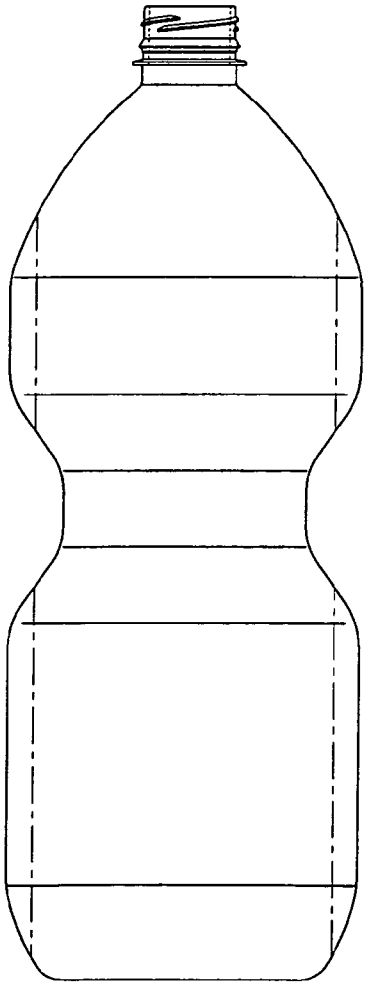

Here, FIG. 3 is a reference view of the specific configuration of the container 1 for easy understanding.

That is, the container 1 of this embodiment can be understood that it is a container which is formed by cutting by a plane along the height direction the position indicated by an alternate dotted line in the front, back and both side views of a cylindrical round bottle of which almost the center in the height direction is narrowed.

The container 1 as mentioned above in this embodiment can be molded into a predetermined shape by subjecting a bottomed cylindrical preform made of a thermoplastic resin which is produced by known injection molding or extrusion molding to biaxial stretch blow molding.

As for the thermoplastic resin, any resin can be used as long as it can be subjected to stretch blow molding. Specifically, thermoplastic polyesters such as polyethylene terephthalate, polybutylene terephthalate, polyethylene naphthalate, polycarbonate, polyarylate, polylactate or copolymers thereof, and a blend of these resins or a blend of these resins with other resins are preferable. In particular, ethylene terephthalate-based thermoplastic polyesters such as polyethylene terephthalate can be preferably used. Acrylonitrile resins, polypropylene, propyrene-ethylene copolymers, polyethylene or the like can also be used.

EXAMPLES

The present invention will be described in more detail according to the examples.

Example 1

A preform (weight: about 35 g) made of polyethylene terephthalate (PET) was heated to about 110° C. (higher than the glass transition temperature (Tg) thereof) and was then placed in a mold which had been heated to about 80° C. Subsequently, while extending the preform by means of a stretch rod, air was blown at a pressure of about 3.0 MPa to conduct biaxial stretch blow molding. Then, cooling blow was conducted at an air supply pressure of about 3.0 MPa, whereby a container with a capacity of about 1800 ml level (fully-filled capacity: about 1900 ml) having a configuration shown in FIG. 1 was obtained.

The size of the resulting container 1 was as follows. Height H: about 310 mm, Height h from the grounded surface 5*a* of the bottom part 5 to the narrowest portion of the round cylindrical narrow part 43: about 150 mm, Diameter ΦD of the narrowest portion of the round cylindrical narrow part 43; about 72 mm, the length L of one side of the rectangular cylindrical parts 41 and 42 of which the cross section is square; about 94 mm; the narrowing ratio ΦD/L of the round cylindrical narrow part 43 relative to the rectangular cylindrical parts 41 and 42: about 0.77.

The average wall thickness of the container 1 which had been calculated from the weight of the preform was about 0.23 mm.

The following compression strength test was conducted for the resulting container 1 (empty container 1 with no contents being filled and sealed), and the compression strength was found to be 59.45N. Buckling occurred at the round cylindrical narrow part 43 (step 431).

<Compression Strength Test>

As the compression strength test, a tensile compression tester SV-201NA-H (special type, manufactured by Imada Seisakusho, Ltd.) was used. For the container 1 which stood upright, a plug was pressed from above of the mouth part 2 toward the lower part in the height direction to allow the container 1 to be compressed at a compression speed of 50 mm/min. A load at which the container was buckled (axial load strength) was measured.

For the empty container 1, the plug presses the container 2 while keeping direct contact with the upper surface of the outer periphery of the mouth part 2. At this time, at a part which contacts the upper surface of the outer periphery of the mouth part 2 at the lower surface of the plug, an air escape groove is provided in order to prevent strength from increasing due to an increase in internal pressure by sealing the opening of the mouth part 2 when the container 1 is compressed.

Then, the resulting container 1 was filled with about 1850 ml of water of about 20° C., and the container 1 was then sealed by installing a lid (not shown) on the mouth part 2. The same compression strength test as mentioned above was conducted. As a result, the compression strength was found to be 354.76N. Buckling occurred at the round cylindrical narrow part 43 (step 431). Here, when the compression test is conducted for the container 1 which is sealed by the lid, the plug presses the container 1 through the lid which is installed to the mouth part 2 and serves to seal the container. Therefore, there is no need to provide on the lower surface of the plug an air escape groove such as that mentioned above.

In conducting the compression strength test, the capacity of a headspace remained in the container 1 was measured at room temperature (about 20° C.), and the capacity was found to be about 50 ml.

Example 2

The compression strength test before and after filling and sealing of the container 1 was conducted in the same manner as in Example 1 for the container 1 having the same shape as that in Example 3 except that the diameter ΦD of the narrowest portion of the round cylindrical narrow part 43 was changed to about 69 mm and the narrowing ratio D/L of the round cylindrical narrow part 43 relative to the rectangular cylindrical parts 41 and 42 was changed to about 0.73 and the shape and dimension of parts (bottom part) which are not closely related to the present invention were changed slightly to meet the fully-filled capacity of about 1900 ml.

As a result, it was found that the compression strength before filling and sealing the container was 65.66N and the compression strength after filling and sealing the container was 361.29N. Buckling occurred at the cylindrical narrow art 43 (step 431) in each of before and after filling.

A container with a capacity of about 2000 ml (fully-filled capacity: 2100 ml) having a configuration shown in FIG. 4 was obtained in the same manner as in Example 1 using a preform (weight: 35 g) made of polyethylene terephthalate (PET).

The size of the resulting container 1 was as follows. Height H: about 310 mm, Height h from the grounded surface 5*a* to the narrowest portion of the round cylindrical narrow part 43: about 150 mm, Diameter ΦD of the narrowest portion of the round cylindrical narrow part 43; about 74 mm, the length L of the longer side and the length $L_0$ of the shorter side of the rectangular cylindrical parts 41 and 42; about 105 mm and 92 mm, respectively; the narrowing ratio ΦD/L of the round cylindrical narrow part 43 relative to the rectangular cylindrical parts 41 and 42: about 0.70.

The average wall thickness of the container 1 which had been calculated from the weight of the preform was about 0.22 mm.

For the resulting container 1, the compression strength test before and after filling and sealing was conducted in the same manner as in Example 1.

As a result, it was found that the compression strength before filling and sealing the container was 65.17N and the compression strength after filling and sealing the container was 226.05N.

As the content, the container 1 was filled with 2050 ml of water of about 20° C. (headspace was 50 ml).

Example 4

The compression strength test before and after filling and sealing of the container was conducted in the same manner as in Example 1 for the container 1 having the same shape as that in Example 3 except that the diameter ΦD of the narrowest portion of the round cylindrical narrow part 43 was changed to about 70 mm and the narrowing ratio ΦD/L of the round cylindrical narrow part 43 relative to the rectangular cylindrical parts 41 and 42 was changed to about 0.67.

As a result, it was found that the compression strength before filling and sealing the container 1 was 62.72N and the compression strength after filling and sealing the container was 250.55N. Buckling occurred at the cylindrical narrow art 43 (step 431) in each of before and after filling.

The present invention was explained hereinabove with reference to preferred embodiments. However, it is needless to say that the present invention is not limited to the above-mentioned embodiments, and various modifications are possible within the scope of the present invention.

For example, in explaining the above-mentioned embodiments, the container 1 shown in FIGS. 1 and 2 has a relatively large capacity of about 1000 to 2000 ml. The present invention is not restricted by the capacity of the container 1, and can be applied to containers with various capacities.

In forming the round cylindrical narrow part 43, in the above-mentioned embodiments, the narrowing ratio of the round cylindrical narrow part 43 relative to the rectangular cylindrical parts 41 and 42 is preferably 0.67 to 0.77 in respect of axial load strength. The narrowing ratio can be modified appropriately according to circumstances. The degree of narrowing of the round cylindrical narrow part 43 relative to the rectangular cylindrical parts 41 and 42 can be appropriately determined.

Figure 5:
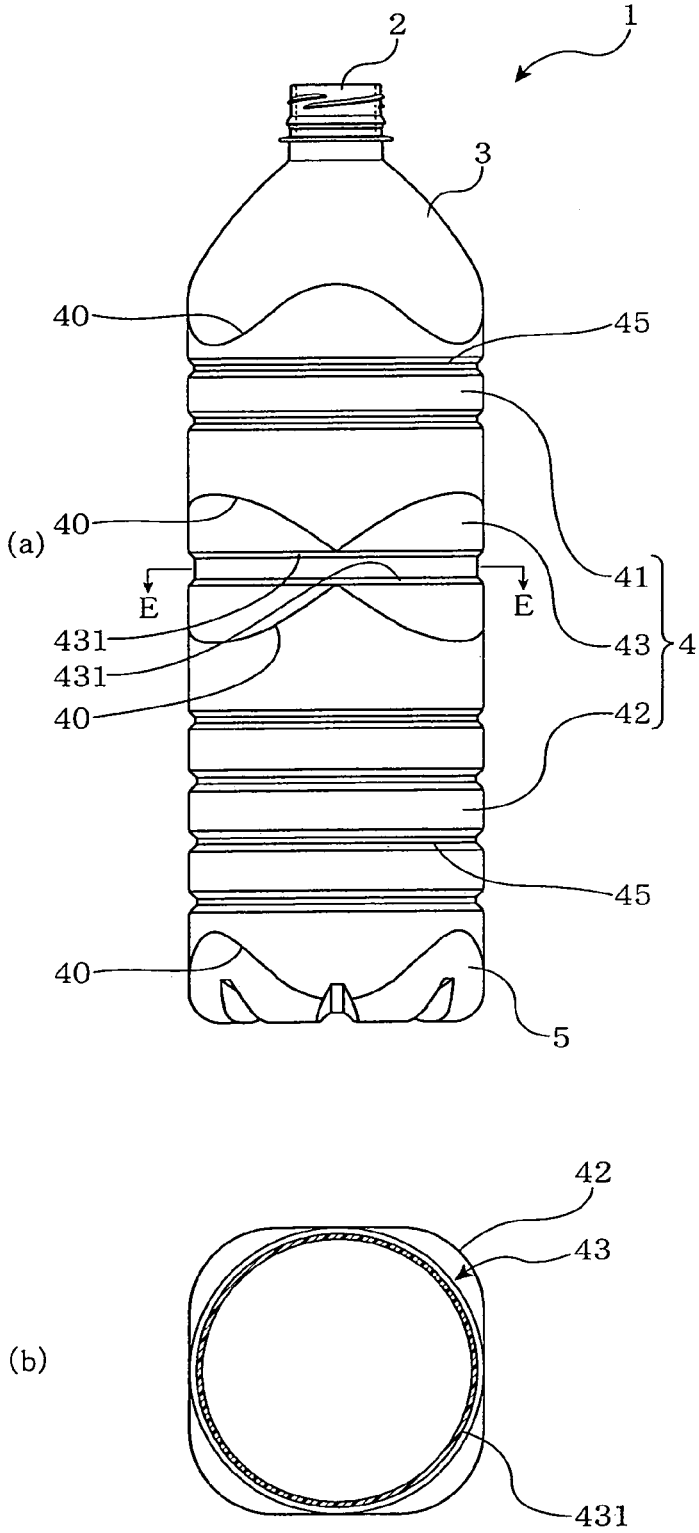
FIG. 5(*a*) is a front view showing still another example of the synthetic resin container according to the present invention.

For example, if the narrowing of the round cylindrical narrow part 43 is smallest, if the cross section of the rectangular cylindrical parts 41 and 42 is square, as shown in FIG. 5, the round cylindrical narrow part 43 may be formed such that the diameter ΦD of the narrowest portion of the round cylindrical narrow part 43 becomes almost similar to the length of one side of the square which constitutes the cross sectional surface of the rectangular cylindrical parts 41 and 42.

Figure 6:
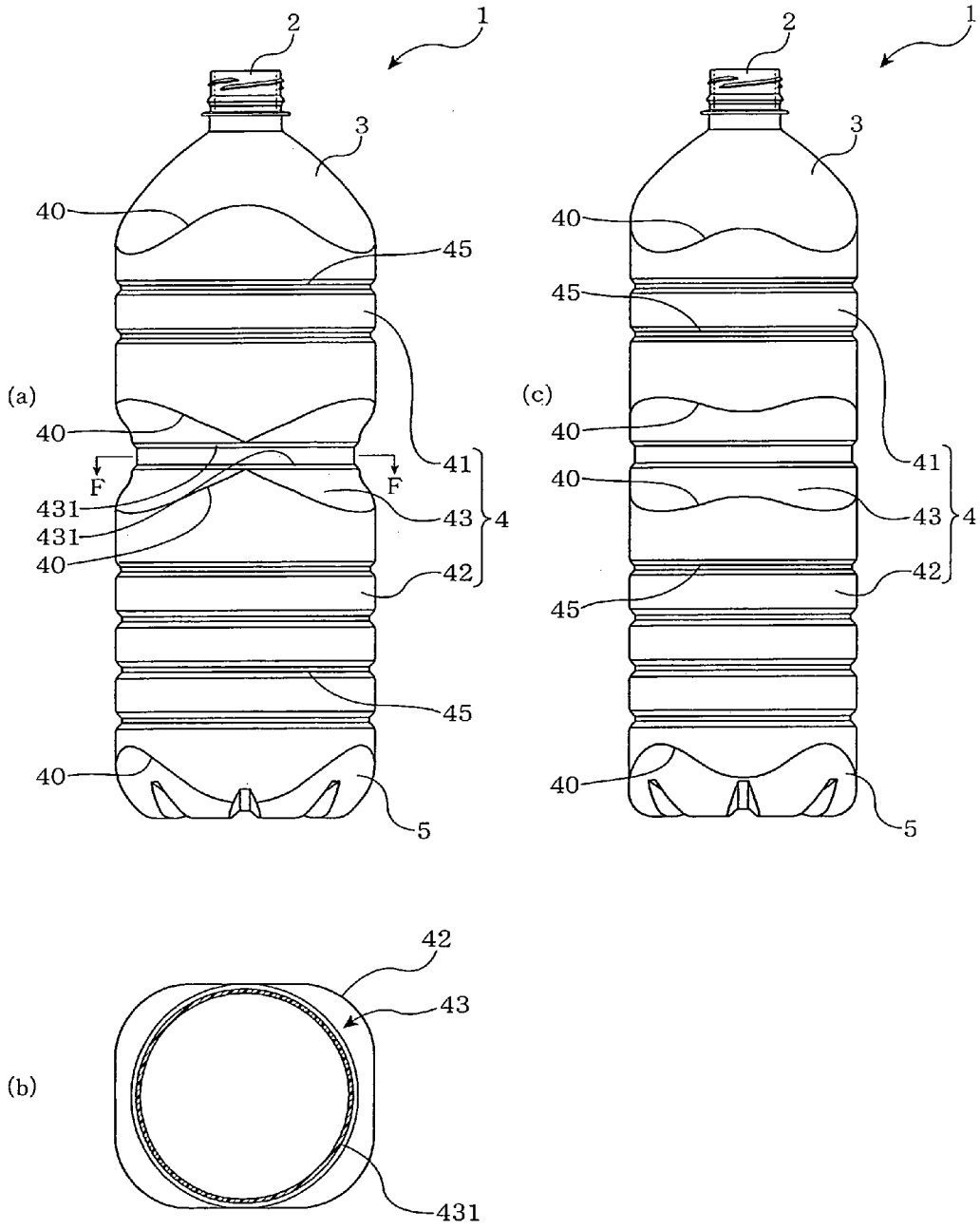
FIG. 6(*a*) is a front view showing still another example of the synthetic resin container according to the present invention.

Similarly, if the cross section of the rectangular cylindrical parts 41 and 42 is rectangular, as shown in FIG. 6, the round cylindrical narrow part 43 may be formed such that the diameter ΦD of the narrowest portion of the round cylindrical narrow part 43 becomes almost similar to the length of the shorter side of the rectangle which constitutes the cross sectional surface of the rectangular cylindrical parts 41 and 42.

FIG. 5 is an explanatory view showing still another example of the synthetic resin container according to this embodiment, in which FIG. 5(*a*) is a front view and FIG. 5(*b*) is a cross sectional view taken along line E-E of FIG. 5(*a*). FIG. 6 is an explanatory view showing still another example of the synthetic resin container according to this embodiment, in which FIG. 6(*a*) is a front view, FIG. 6(*b*) is a side view, and FIG. 6(*c*) is a cross sectional view taken along line F-F of FIG. 6(*a*). As in the case of the cross sectional view shown in FIG. 2, in FIGS. 5(*b*) and 6(*c*), the wall thickness of the section of the trunk part 4 is shown in an exaggerated manner, and the internal morphology of the container 1 which can be seen from a section of the trunk part 4 is not shown.

In the container 1 shown in FIGS. 1 and 2, the round cylindrical narrow part 43 is narrowed such that the contour along its height direction becomes a curved line (a curved line which forms convexity towards the inside of the container). The manner of narrowing is, however, also arbitral. For example, the round cylindrical narrow part 43 is narrowed such that the contour along its height direction becomes linear so that the round cylindrical narrow part 43 continues to the rectangular cylindrical parts 41 and 42 through a part formed in a conical shape.

In the container 1 shown in FIGS. 1 and 2, the narrowest portion of the round cylindrical narrow part 43 has a constant width in the height direction with a space between the pair of steps 431 and 431 being substantially same in diameter. However, the round cylindrical narrow part 43 may be narrowed such that the diameter ΦD of the narrowest portion shows a single minimum value at a predetermined position in the height direction.

Figure 8:
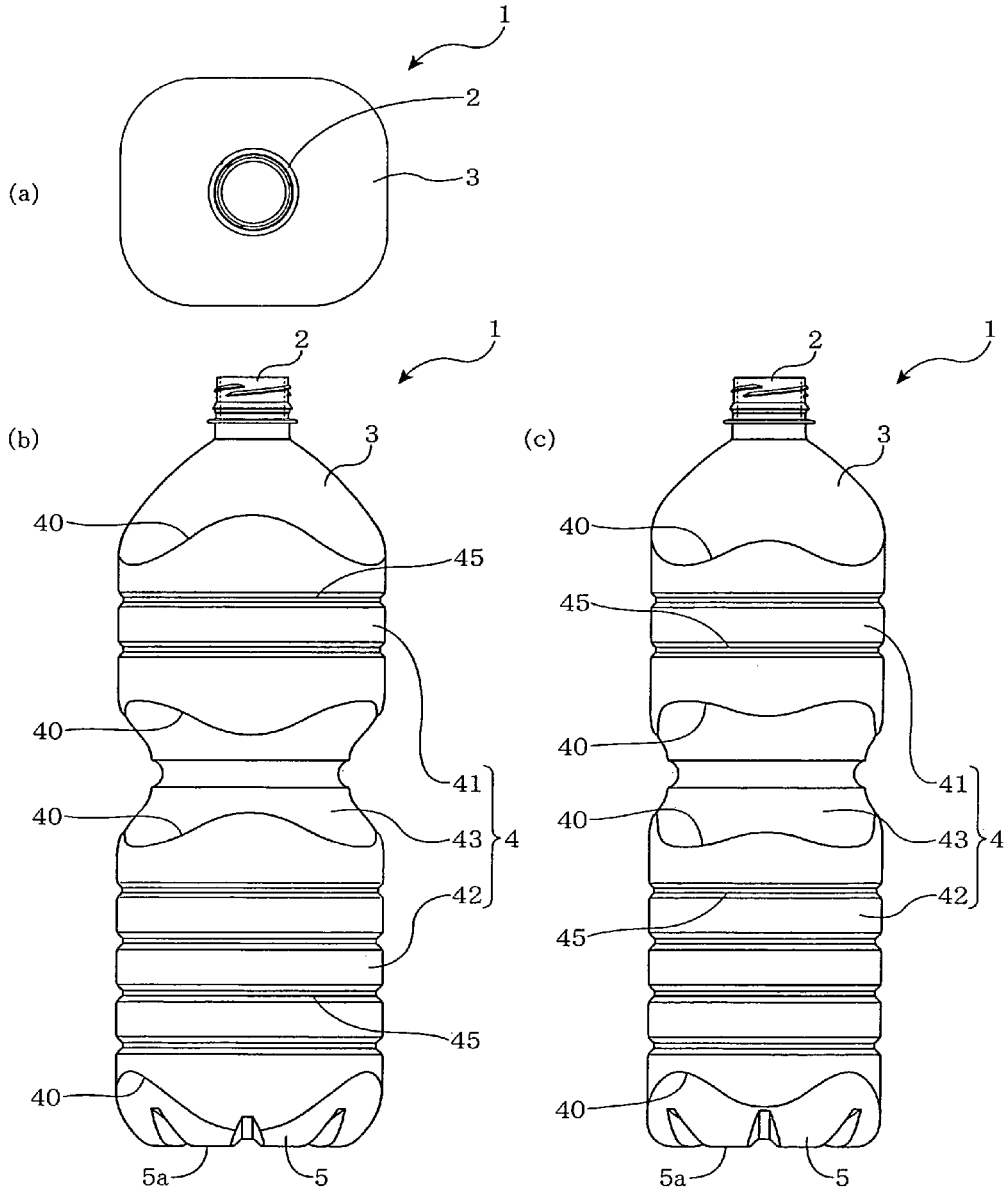
FIG. 8(*a*) is a plan view showing still another example of the synthetic resin container according to the present invention.
Figure 9:
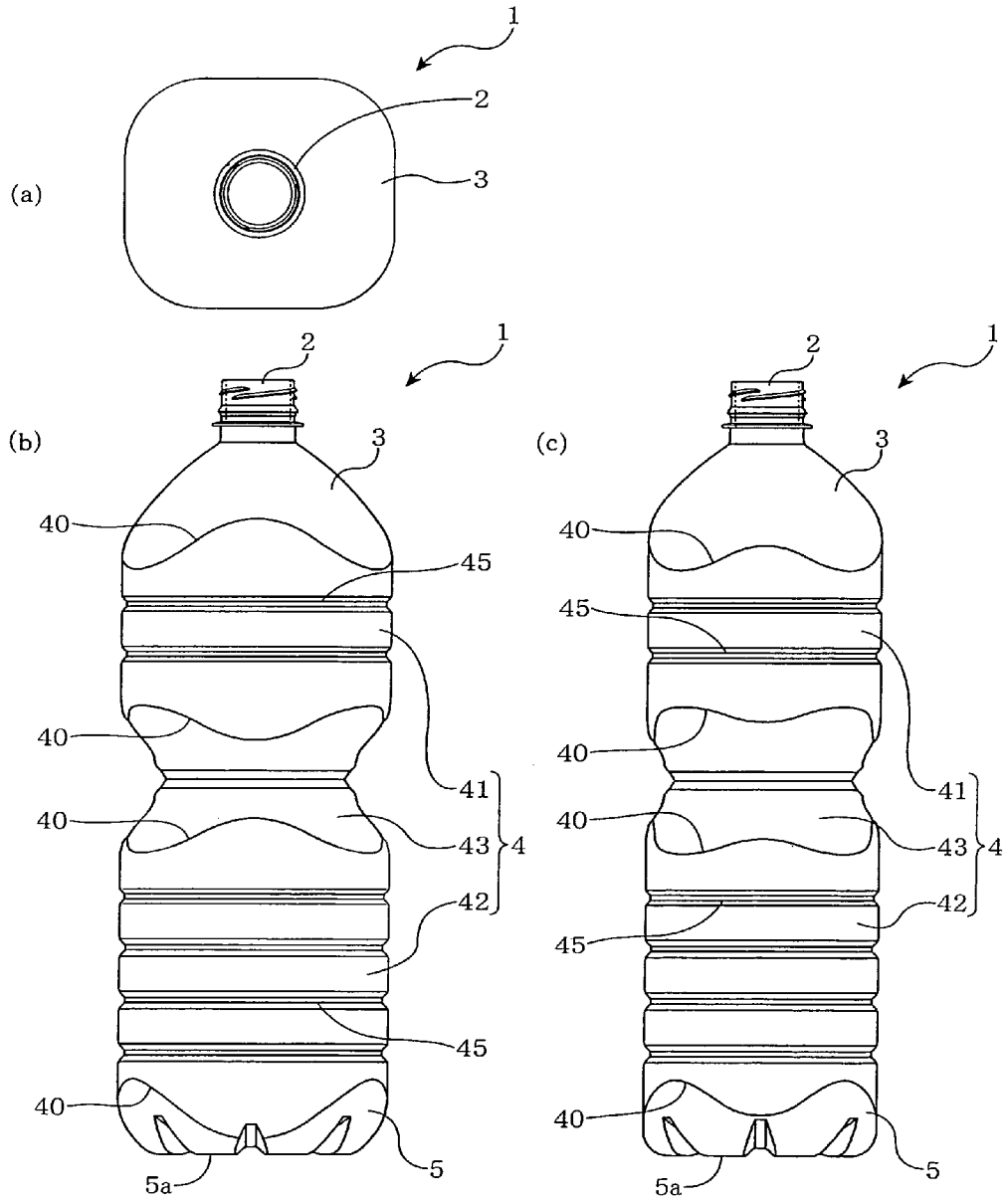
FIG. 9(*a*) is a plan view showing still another example of the synthetic resin container according to the present invention.

For example, the narrowest portion of the round cylindrical narrow part 43 may be in a U-shape as shown in FIG. 8, or in a V-shape as shown in FIG. 9. In the examples shown in FIGS. 8 and 9, the steps 431 and 431 are not shown. However, also in the examples shown in FIGS. 8 and 9, steps 431 and 431 which are similar to those in the above-mentioned examples may be formed.

FIGS. 8 and 9 are explanatory views showing still another example of the synthetic resin container according to this embodiment, in which FIG. 8(*a*) and FIG. 9(*a*) are plan views, FIG. 8(*b*) and FIG. 9(*b*) are front views and FIG. 8(*c*) and FIG. 9(*c*) are side views.

In the above-mentioned embodiments, an example is shown in which a pair of steps 431 and 431 is formed in the round cylindrical narrow part 43. The manner of forming the step 431 is not limited thereto. Three or more steps 431 may be formed in the circumferential direction of the round cylindrical narrow part 43.

Figure 10:
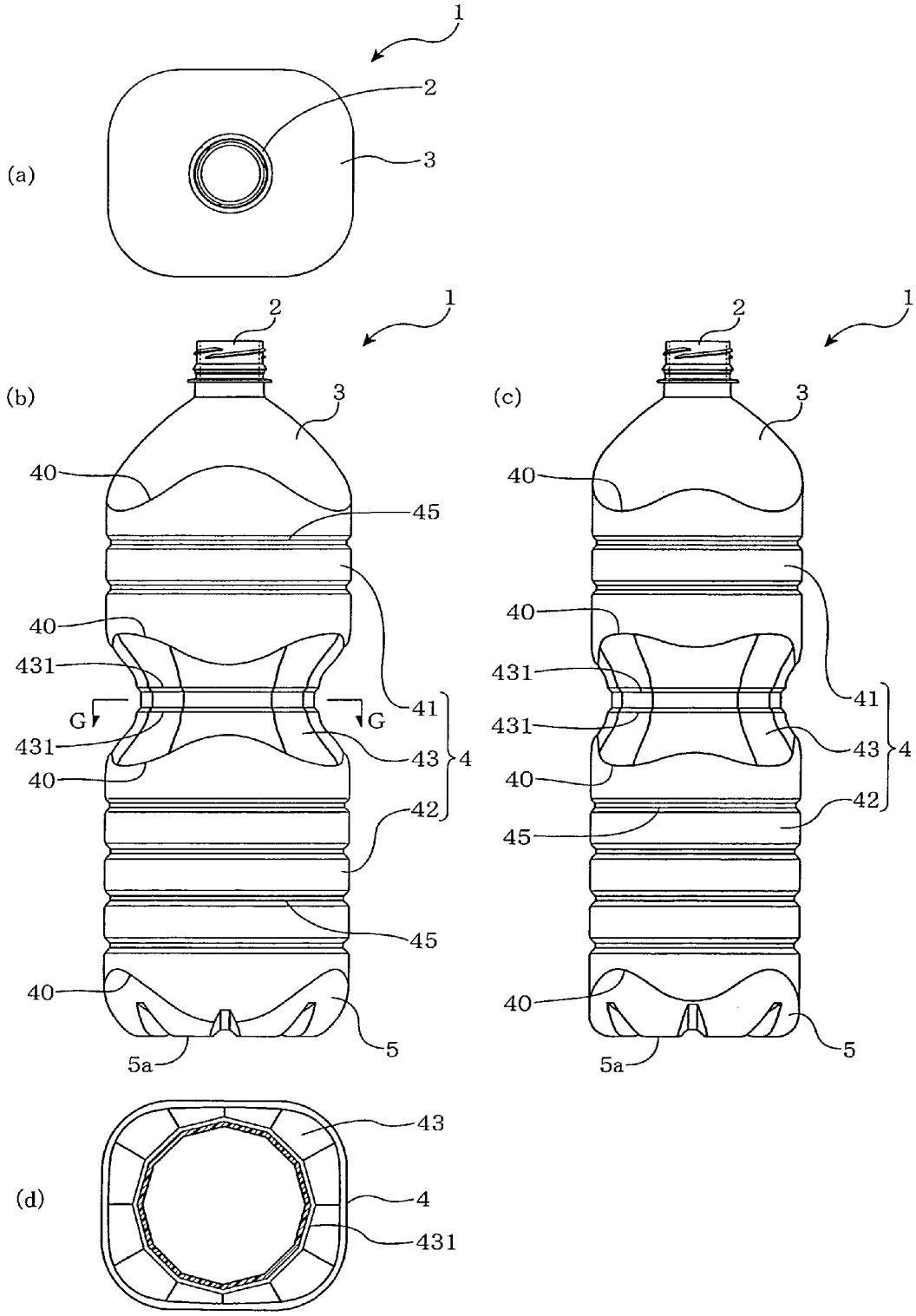
FIG. 10(*a*) is a plan view showing still another example of the synthetic resin container according to the present invention.

The round cylindrical narrow part 43 may be formed such that the cross section thereof may have a polygonal shape (dodecagonal in the example shown in FIG. 10) as shown in FIG. 10, as long as the shape of the cross section thereof is close to a circular shape. As long as the advantageous effects of the present invention are not impaired, a round cylindrical narrow part with such a shape may be included in the concept of the "round cylindrical narrow part". In this case, only the narrowest portion of the cylindrical part 43 may have a polygonal cross section which is close to circular, as shown in FIG. 11.

Figure 11:
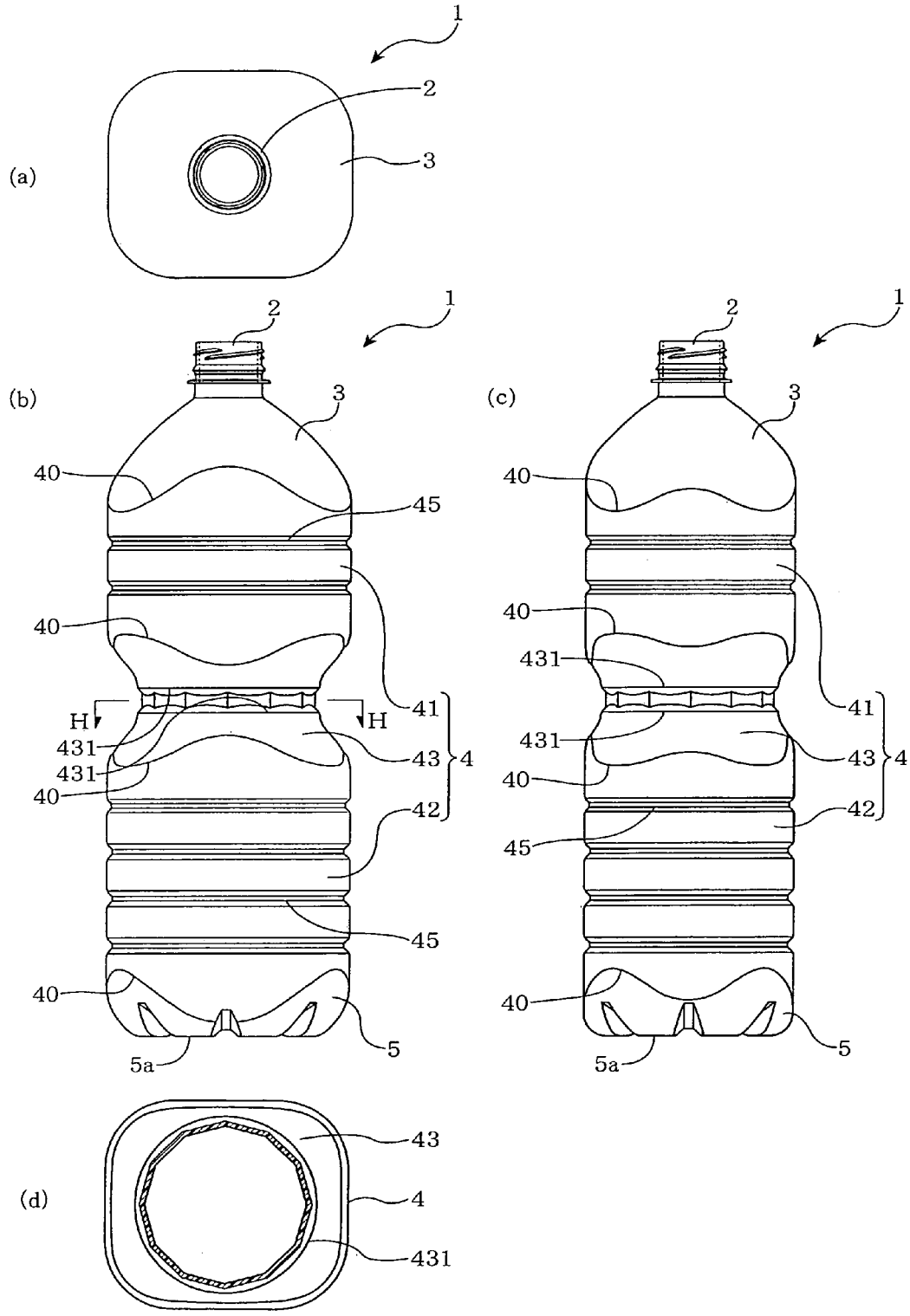
FIG. 11(*a*) is a plan view showing still another example of the synthetic resin container according to the present invention.

FIGS. 10 and 11 are explanatory views showing still another example of the synthetic resin container according to this embodiment, in which FIG. 10(*a*) and FIG. 11(*a*) are plan views, FIG. 10(*b*) and FIG. 11(*b*) are front views, and FIG. 10(*c*) and FIG. 11(*c*) are side views. FIG. 10(*d*) is a cross sectional view taken along line G-G of FIG. 10(*b*) and FIG. 11(*d*) is a cross-section view taken along line H-H of FIG. 11(*b*). In these cross sectional views, the wall thickness of the section of the trunk part 4 is shown in an exaggerated manner and the internal morphology of the container 1 which can be seen from a section of the trunk part 4 is not shown.

Figure 12:
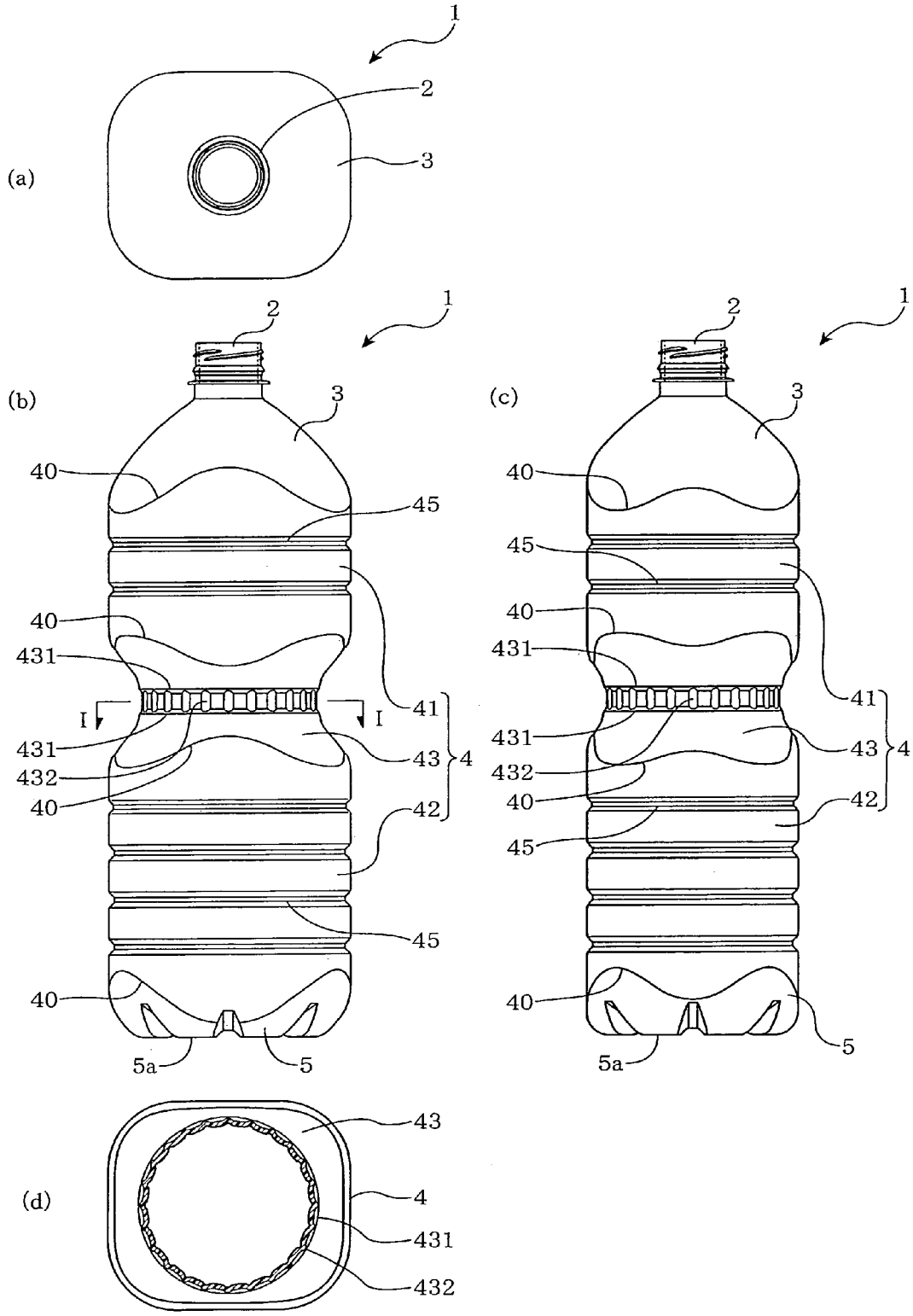
FIG. 12(*a*) is a plan view showing still another example of the synthetic resin container according to the present invention.
Figure 13:
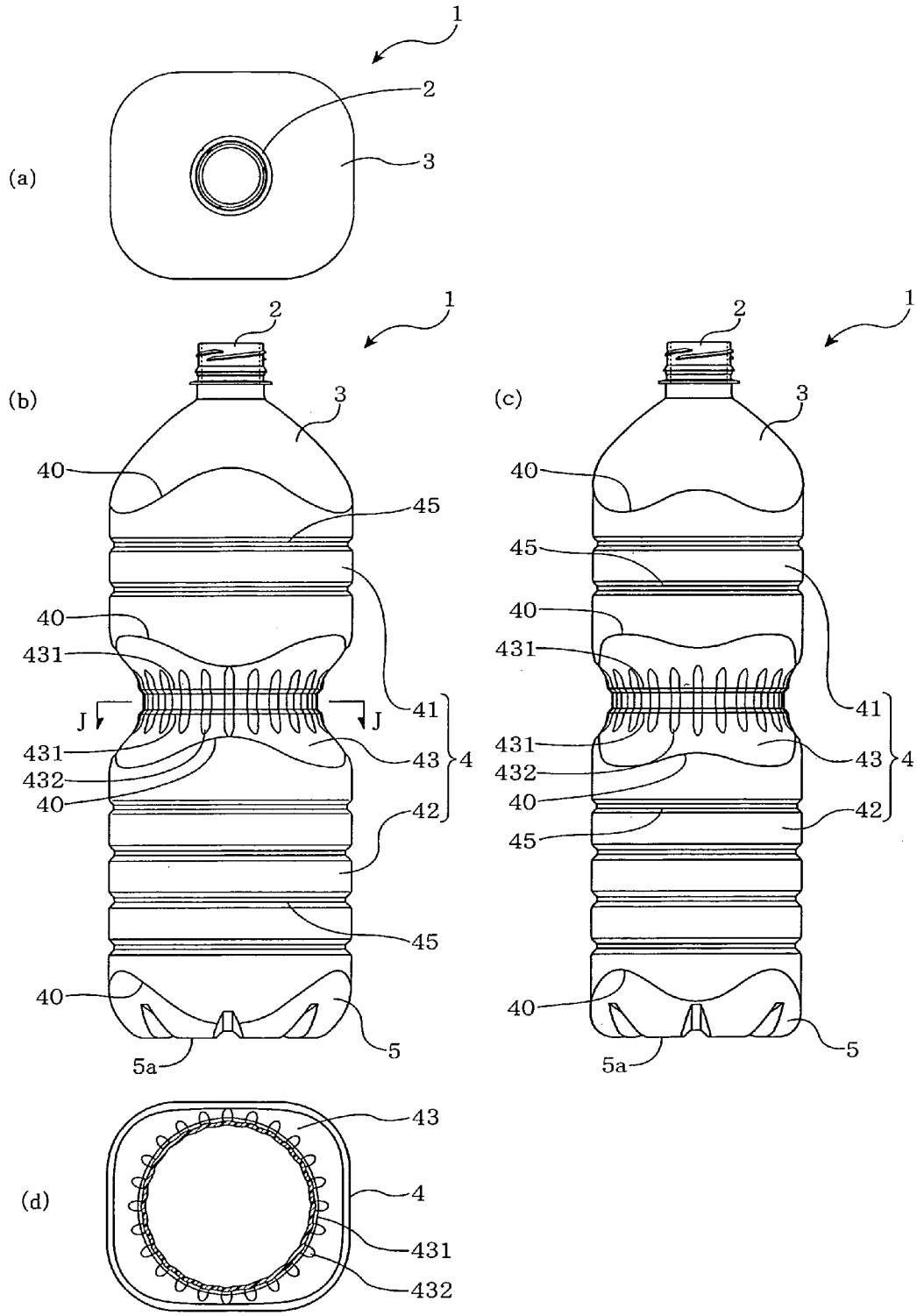
FIG. 13(*a*) is a plan view showing still another example of the synthetic resin container according to the present invention FIG. 13(*b*) is a front view showing still another example of the synthetic resin container according to the present invention.

As shown in FIG. 12 and FIG. 13, a rib 432 for reinforcement may be formed in the round cylindrical narrow part 43. In this case, as for the specific embodiment of forming the rib 432, the rib 432 may be formed at the narrowest portion of the round cylindrical narrow part 43, as shown in FIG. 12. The rib 432 may be formed in such a manner that it protrudes upwardly and downwardly in the height direction from the narrowest portion of the round cylindrical narrow part 43 as shown in FIG. 13.

FIG. 12 and FIG. 13 are explanatory views for showing still another example of the synthetic resin container according to this embodiment, in which FIG. 12(*a*) and FIG. 13(*a*) are plan views, FIG. 12(*b*) and FIG. 13(*b*) are front views and FIG. 12(*c*) and FIG. 13(*c*) are side views. FIG. 12(*d*) is a cross sectional view taken line along I-I of FIG. 12(*b*), and FIG. 13(*d*) is a cross sectional view taken line along J-J of FIG. 13(*b*). In these cross sectional views, the wall thickness of the section of the trunk part 4 is shown in an exaggerated manner and the internal morphology of the container 1 which can be seen from a section of the trunk part 4 is not shown.

The specific configurations of the mouth part 2, the shoulder part 3, the plane parts and the corner parts of the rectangular cylindrical parts 41 and 42 and the bottom part 5 are not limited to those shown in the figures, and they may have various configurations within the scope of the present invention.

INDUSTRIAL APPLICABILITY

The synthetic resin container of the present invention can be applied to various synthetic resin containers molded into a bottle shape without being restricted on the capacity.

The invention claimed is:

1. A synthetic resin container, comprising:

a mouth part, a shoulder part, a trunk part, and a bottom part, wherein said trunk part has a round cylindrical narrow part, an upper rectangular cylindrical part present on a side where the shoulder part is present, and a lower rectangular cylindrical part present on a side where the bottom part is present, the round cylindrical narrow part is formed by narrowing a predetermined height position of said trunk part from a lower end of the upper rectangular cylindrical part and an upper end of the lower rectangular cylindrical part, an upper end of said round cylindrical narrow part continues to said upper rectangular cylindrical part and a lower end of said round cylindrical narrow part continues to said lower rectangular cylindrical part such that a cross sectional shape thereof becomes closer to a cross sectional shape of said upper rectangular cylindrical part and said lower rectangular cylindrical part respectively while increasing a diameter of said round cylindrical narrow part concentrically from a narrowest portion upwardly and downwardly in a height direction, a boundary between said upper rectangular cylindrical part and said round cylindrical narrow part is positioned at a closest part to said shoulder part in a corner part of said upper rectangular cylindrical part, a boundary between said lower rectangular cylindrical part and said round cylindrical narrow part is positioned at a closest part to said bottom part in a corner part of said lower rectangular cylindrical parts, and the upper rectangular cylindrical part and the lower rectangular cylindrical part have a rectangular shape in a cross section orthogonally crossing the height direction.

2. The synthetic resin container according to claim 1, wherein the cross section orthogonally crossing the height direction of the narrowest portion of said round cylindrical narrow part has a circular shape.

3. The synthetic resin container according to claim 2, wherein a ridge line is molded in the boundary between said upper rectangular cylindrical part and said round cylindrical narrow part and in the boundary between said lower rectangular cylindrical part and said round cylindrical narrow part.

4. The synthetic resin container according to claim 2, wherein a pair of steps which is positioned above and below in the height direction with the narrowest portion of said round cylindrical narrow part being sandwiched therebetween is formed in a circumferential direction.

5. The synthetic resin container according to claim 1, wherein a ridge line is molded in the boundary between said upper rectangular cylindrical part and said round cylindrical narrow part and in the boundary between said lower rectangular cylindrical part and said round cylindrical narrow part.

6. The synthetic resin container according to claim 5, wherein the ridge line is a wavy line curved up and down in the height direction.

7. The synthetic resin container according to claim 1, wherein a pair of steps which is positioned above and below in the height direction with the narrowest portion of said round cylindrical narrow part being sandwiched therebetween is formed in a circumferential direction.

8. The synthetic resin container according to claim 7, further comprising a rib formed on the round cylindrical narrow part.

9. The synthetic resin container according to claim 8, wherein the rib is formed at the narrowest portion of said round cylindrical narrow part such that the rib protrudes upwardly and downwardly in the height direction from the narrowest portion of said round cylindrical narrow part.

* * * * *